US007401386B2

(12) United States Patent
Cannon

(10) Patent No.: US 7,401,386 B2
(45) Date of Patent: Jul. 22, 2008

(54) DENTAL BIB HOLDING DEVICE AND METHOD OF USING SAME

(76) Inventor: James L. Cannon, 5297 Cleveland Hwy., Clermont, GA (US) 30527

( * ) Notice: Subject to any disclaimer, the term of this patent is extended or adjusted under 35 U.S.C. 154(b) by 135 days.

(21) Appl. No.: 11/109,503

(22) Filed: Apr. 19, 2005

(65) Prior Publication Data

US 2005/0210558 A1 Sep. 29, 2005

(51) Int. Cl.
*A45F 5/04* (2006.01)

(52) U.S. Cl. ..... 24/3.4; 24/7; 24/298

(58) Field of Classification Search ..... 24/7, 24/9, 3.4, 3.12, 3.13
See application file for complete search history.

(56) References Cited

U.S. PATENT DOCUMENTS 579,788 A * 3/1897 Brodeur ..... 2/132
675,108 A * 5/1901 Perkins ..... 24/9
868,817 A * 10/1907 Smith ..... 24/9
948,576 A * 2/1910 Frick ..... 24/9
1,551,829 A * 9/1925 Maxwell ..... 24/299
2,820,269 A * 1/1958 Wolff ..... 24/9
3,010,110 A * 11/1961 Kirk ..... 2/49.1
D358,700 S * 5/1995 Porteous ..... D2/624
5,414,903 A * 5/1995 Porteous ..... 24/9
D393,183 S * 4/1998 Kurtzman ..... D7/633
5,774,950 A * 7/1998 Stout ..... 24/298
5,852,849 A * 12/1998 Lansing et al. ..... 24/3.4
6,523,227 B2 * 2/2003 Goodall ..... 24/3.1
6,652,431 B1 * 11/2003 Mattox ..... 482/139
2006/0117465 A1 * 6/2006 Willows et al. ..... 2/338

* cited by examiner

*Primary Examiner*—Jack W. Lavinder
(74) *Attorney, Agent, or Firm*—King & Spalding

(57) ABSTRACT

There is disclosed an improved bib retaining device. The bib retaining device comprises an elongate resilient member having a central portion and opposite end portions, the central portion of the elongate resilient member being formed into a neck engaging portion, the end portions extending outwardly from the neck engaging portion, and a bib retaining member attached to each end portion of the elongate resilient member. A method of using a bib retaining device is also disclosed.

8 Claims, 2 Drawing Sheets

DENTAL BIB HOLDING DEVICE AND METHOD OF USING SAME

FIELD OF THE INVENTION

The present invention relates to a medical device. Specifically, the medical device retains a bib around a patient's neck during dental, orthodontic or similar procedures. A method of using the device is also disclosed.

BACKGROUND OF THE INVENTION

During dental, orthodontic or similar medical procedures, an absorbent bib is usually placed adjacent the neck of a patient undergoing such procedures in order to protect the patient's clothing from saliva, blood, water, drugs, and other chemicals or compounds that may be expelled or ejected from the patients mouth during such medical procedures. The dental bib is typically made from nonwoven, natural and/or synthetic materials which have excellent fluid absorption properties.

The prior art method of securing a dental bib around a patient's neck usually employs an elongate flexible member, such as a chain, tube, cord or the like, having clips attached at the distal ends of the flexible member. The elongate flexible member is loosely placed around the neck of a patient and the clips are secured to the bib. The flexible member therefore merely hangs loosely around the patient's neck and the bib lays on the patient's chest. Typically, the bib does not fit tightly against the patient's neck, but, rather, is spaced from the patient's neck thereby exposing the upper portion of the patient's clothing. Also, when treating young, fidgety children, the elongate flexible member can rotate on the patient's neck thereby permitting the bib to slide to the side of the patient's body.

Accordingly, there is a need for a device that retains a dental bib snuggly against a patient's neck. This will result in more effective protection of the patient clothing and more satisfied dental patients. Furthermore, with the present invention, the dentist, dental hygienist or dental technician will not have to continually adjust the dental bid for certain patients.

SUMMARY OF THE INVENTION

The present invention satisfies the above-described needs by providing an improved bib retaining device. The device of the present invention comprises an elongate resilient member having a central portion and opposite end portions. The central portion of the elongate resilient member is formed into a neck engaging portion. The end portions of the elongate resilient member extend outwardly from the neck engaging portion. A bib retaining member is attached to each end portion of the elongate resilient member.

In an alternate embodiment of the present invention, there is disclosed an improved method of retaining a dental bib on a patient. The method comprises positioning a bib retaining device around the neck of a person. The bib retaining device comprising an elongate resilient member having a central portion and opposite end portions. The central portion is formed into a neck engaging portion. The end portions extend outwardly from the neck engaging portion and a bib retaining member is attached to each end portion of the elongate resilient member. A bib is attached to one of the bib retaining members. Then, the elongate resilient member is compressed by moving the opposite end portions toward each other. The bib is attached to the other of the bib retaining members at a position spaced from the one bib retaining member while the elongate resilient member is compressed, such that when the elongate resilient member is released, the portion of the bib between the spaced bib retaining members is under tension and the bib is held adjacent the person's neck.

Accordingly, it is an object of the present invention to provide an improved bib retaining device.

Another object of the present invention is to provide an improved method of retaining a dental bib adjacent a patient's neck.

A further object of the present invention is to provide a device that provides improved protection for a patient's clothing during dental, orthodontic or other medical procedures.

These and other objects, features and advantages of the present invention will become apparent upon reviewing the following detailed description of the disclosed embodiments and the appended drawing and claims.

DETAILED DESCRIPTION OF THE DISCLOSED EMBODIMENTS

Figure 1:
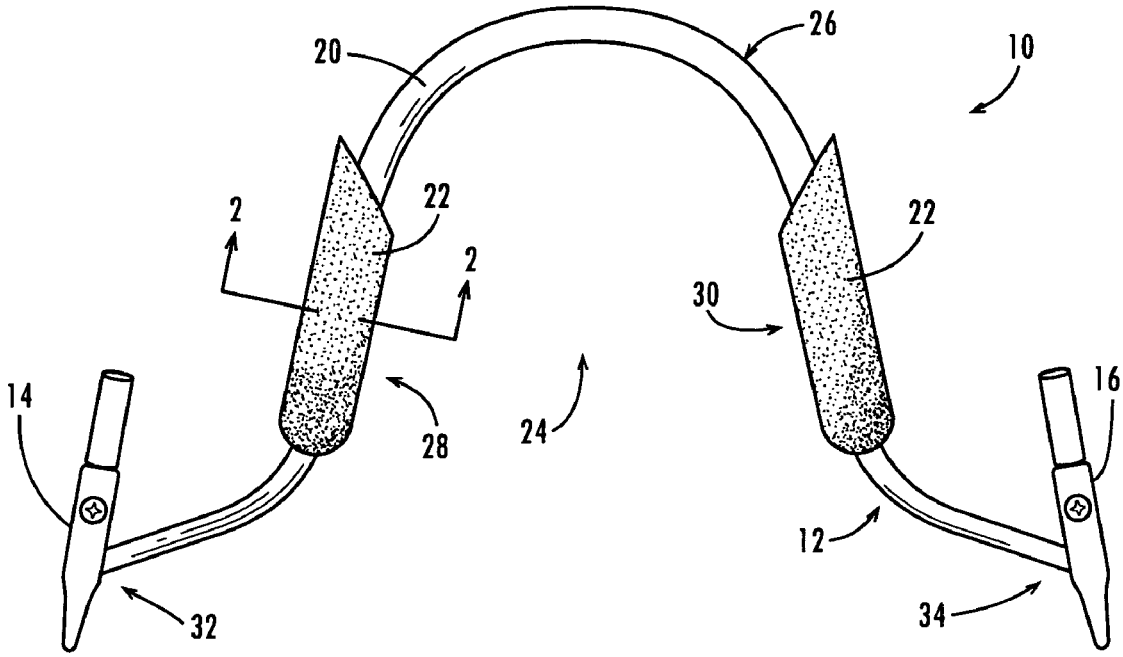
FIG. 1 is a perspective view of a disclosed embodiments of the bib retaining device of the present invention.

With reference to the drawing in which like numbers indicate like elements throughout the several views, it will be seen that there is a bib retaining device 10. The bib retaining device 10 comprises an elongate resilient member 12 having bib retaining clips 14, 16 attached at opposite ends thereof. The resilient member 12 can be made from any substance that is rigid enough that it can be formed generally into the shape shown in FIG. 1 and retain that shape, but which has spring-like qualities when the opposite ends of the resilient member are moved toward each other, so that they will spring back to their original position when released. The resilient member 12 can be made from substances including, but not limited to, metal or plastics. Preferably, the resilient member 12 comprises an inner core of surgical stainless steel wire 18 (FIG. 2) which is substantially completely disposed within a plastic tube 20. The wire 18 can have a gauge of approximately 0.04 to approximately 0.05; preferably, approximately 0.045. Wire 18 suitable for use in the present invention can be purchased from any orthodontic supplier.

The plastic tube 20 is relatively rigid, but can be deformed generally into the shape shown in FIG. 1. The plastic tube 20 can be made from materials including, but not limited to, polyethylene, polypropylene, acrylic polymers, vinyl polymers, polyurethanes, copolymers thereof and mixtures thereof. Preferably, the plastic tube 20 is made from polyethylene or a dense polymeric foam. The plastic tube 20 can be of any convenient size, such as an outside diameter of approximately ¼ inch. The purpose of the plastic tube 20 is to provide a degree of cushioning effect to the wire 18 when the device 10 is worn around a patient's neck. Plastic tubes 20 suitable for use in the present invention can be purchased from hydraulic suppliers.

Although the elongate resilient member 12 in accordance with the present invention has been illustrated as comprising a metal wire 18 inside a plastic tube 20, it is specifically contemplated that the elongate resilient member can also comprise a metal or plastic wire coated with a polymeric coating or a foamed polymeric coating. The coating of wires with polymers or polymeric foams is well known in the art, and, therefore, will not be explained further here. It is also contemplated that the elongate resilient member can be made from plastic or polymeric materials. If the elongate resilient member is made from a polymeric material, it must be sufficiently rigid such that it retains its shape, but be sufficiently resilient such that it has spring properties with respect to compression of its opposite ends, as described above. Suitable polymers include, but are not limited to, polyethylene, polypropylene, acrylic polymers, vinyl polymers, polyurethanes, copolymers thereof and mixtures thereof.

Optionally, the elongate resilient member 12 can include an additional cushioning member 22. The cushioning member 22 comprises an elongate tube of a polymeric foam material. The cushioning member 22 fits over the plastic tube 20. Although the cushioning member 22 is shown in FIG. 1 as two separate pieces, it is specifically contemplated that the cushioning member can be formed from a single, longer piece of polymeric foam material. The cushioning member can be made from any polymeric foam material as long as it provides a cushioning effect and is relatively soft and comfortable to wear.

The bib retaining device 10 is made by either bending the wire 18 into the desired shape and then inserting the wire into the plastic tube 20; or the wire can be inserted into the plastic tube and then formed into the desired shape. In either case, the central portion 24 of the elongate resilient member 12 is formed into a shape that will fit the back and sides of a person's neck or generally into a U-shape comprising a curved portion 26 and two generally parallel leg portions 28, 30. The opposite ends 32, 34 of the elongate resilient member 12 extend outwardly from the from the leg portions 28, 30 at an obtuse angle; preferably, approximately 135°. Either before or after the elongate resilient member 12 has been formed into the desired shape, the two cushioning members 22 are slipped onto the plastic tube 20 and positioned intermediate the central portion 26 and the end portions 32, 34 of the elongate resilient member.

Figure 3:
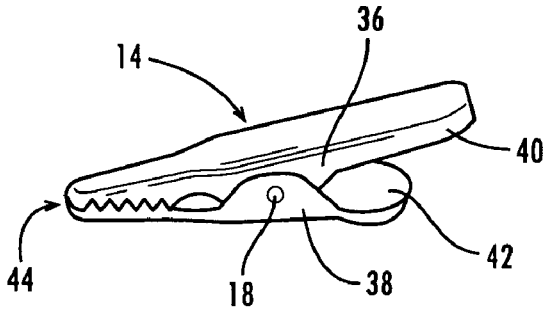
FIG. 3 is a detail view of the bib clip member shown in FIG. 1.

The bib retaining clips 14, 16, which are preferably alligator clips, are then attached to the opposite ends 32, 34 of the elongate resilient member 12 or preferably to the opposite ends of the wire 18. The bib retaining clips 14, 16 include an upper member 36 and a lower member 38. A spring (not shown) biases the upper member 36 and a lower member 38 into a closed position (as shown in FIG. 3). By squeezing the opposite handle portions 40, 42 together, the upper member 36 and a lower member 38 pivot on an axis and open the jaws 44 of the bib retaining clips 14, 16. In a preferred embodiment, the opposite ends of the wire 18 provide the pivoting axis (FIG. 3) for the upper member 36 and a lower member 38 of the bib retaining clips 14, 16. The bib retaining clips 14, 16 are attached to the opposite end of the wire 18 by any suitable means, such as by bending the end of the wire 18 or enlarging the ends of the wire after they pass through the upper and lower members of the bib retaining clips. In a preferred embedment, the bib retaining members 14, 16 are rotatably attached to the wire 18.

Figure 4:
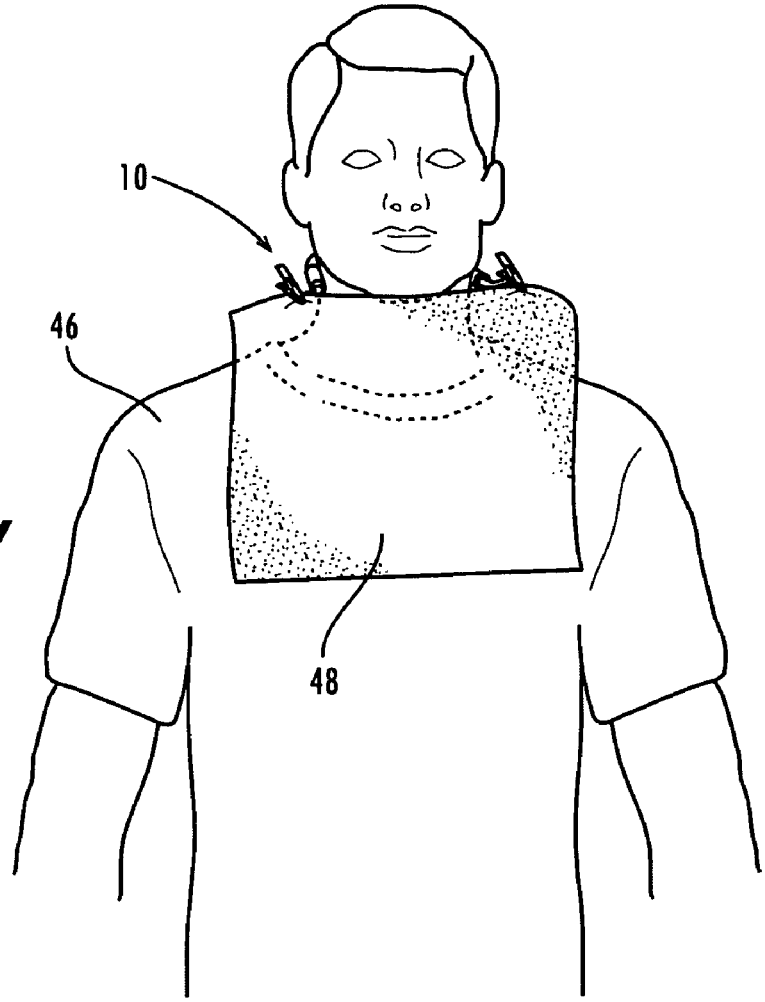
FIG. 4 is a perspective view showing a patient wearing the bib retaining device shown in FIG. 1.

Use of the bib retaining device 10 will now be considered. The bib retaining device 10 is positioned around the neck of a patient 46 (FIG. 4) so that the curved portion 26 of the elongate resilient member 12 fits the back of the patient's neck and the leg portions 28, 30 contact the sides of the patient's neck. A dental bib 48 is then secured to the bib retaining clip 14. Before securing the other bib retaining clip 16 to the dental bib 48, the bib retaining clips 14, 16, or the opposite end portions 32, 34 of the elongate resilient member, are moved towards each other slightly so that the elongate resilient member is compressed slightly. While the elongate resilient member 12 is in this compressed state, the other bib retaining clip 16 is attached to the dental bib 48. When the bib retaining clips 14, 16 are released, the elongate resilient member 12 seeks to return to its uncompressed state, which provides a biasing force to the bib retaining clips to cause then to try and move away from each other. This biasing force places the portion of the dental bib 48 disposed between the bib retaining clips 14, 16 under a slight tension, which holds the dental bid close to the neck of the patient 46.

The size of the U-shaped central portion 24 of the elongate resilient member 12 is adjusted to accommodate different sized necks. Larger necks require that the distance between the leg portions 28, 30 be greater; smaller necks require that the distance between the leg portions be smaller. The length of the elongate resilient member 12, the position at which the end portions 32, 34 bend outwardly from the leg portions 28, 30 and the angle between the end portions and the leg portions can all be adjusted such that when the bib retaining device 10 is positioned around the neck of a patient 46, a line formed between the bib retaining clips 14, 16 is either even with the from of the patient's neck or slightly anterior thereof.

When positioning the bib retaining device 10 around the neck of a patient 46, it is desirable that the distance between the leg portions 28, 30 be such that the leg portions must be separated or spread slightly to get the bib retaining device around the patient's neck. When the bib retaining device 10 is released, the leg portions 28, 30 seek their original position which provides a biasing force which tends to move the leg portions toward each other. This biasing force on the leg portions 28, 30 makes the leg portions tend to grip the neck of the patient 46, and, thereby, keep the bib retaining device 10 in the desired position on the patient's neck.

Figure 2:
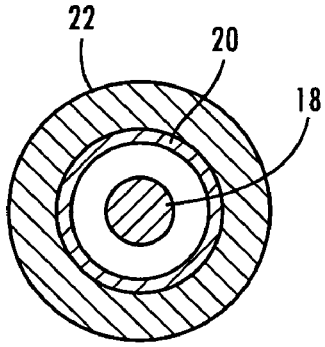
FIG. 2 is a cross-sectional view of the device shown in FIG. 1 taken along the line 2-2.
Figure 5:
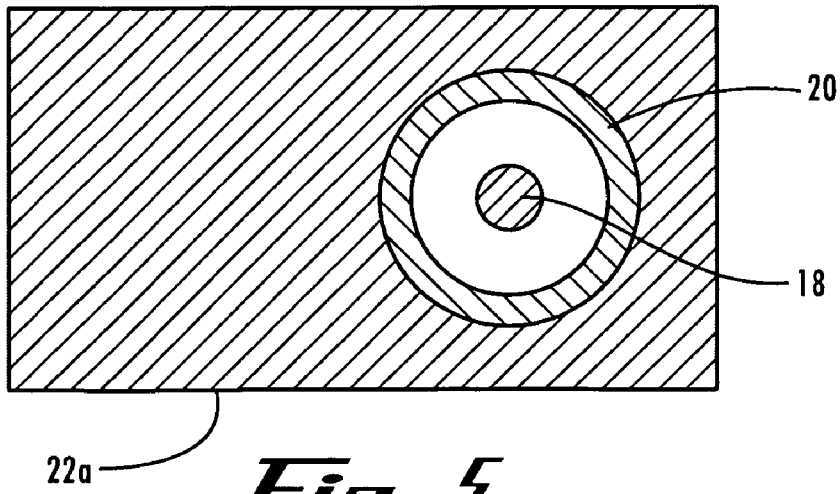
FIG. 5 is a cross-sectional view of an alternate disclosed embodiment of the cushioning member shown in FIG. 2.

With reference to FIG. 5, there is disclosed an alternate disclosed embodiment of the cushioning member 22 shown in FIGS. 1 and 2. In the alternate disclosed embodiment, the cushioning member 22*a* has a rectangular cross-section. Although the cushioning member 22*a* has been illustrated as having a rectangular cross-section, it is specifically contemplated that other geometric shapes can also be used including, but not limited to, elliptical, oval, tear drop and any other shape that is asymmetric with respect to the plastic tube 20 mounting hole in the cushioning member, and provides a surface that is comfortable to wear around a patient's neck. The cushioning member 22*a* is rotatably mounted eccentrically on the plastic tube 20. By rotating the cushioning member 22*a* on the plastic tube 20 such that the longer portion of the cushioning members point toward each other, the effective distance between them is reduced. By reducing the distance between the cushioning members 22*a* on the leg portions 28, 30 of the elongate resilient member 12, relatively smaller necks can be fit with the bib retaining device 10.

It should be understood, of course, that the foregoing relates only to certain disclosed embodiments of the present invention and that numerous modifications or alterations may be made therein without departing from the spirit and scope of the invention as set forth in the appended claims.

What is claimed is:

1. A device comprising:

an elongate spring wire having a central portion and opposite end portions;

said central portion of said elongate spring wire being U-shaped such that it forms a curved portion intermediate substantially parallel leg portions;

the opposite end portions of said spring wire extending outwardly from said central portion such that each end portion forms an obtuse angle with respect to its corresponding leg portion; and a bib retaining member attached to each end portion of said elongate spring wire.

2. A method comprising:

positioning a bib retaining device around the neck of a person, said bib retaining device comprising an elongate resilient member having a central portion and opposite end portions, said central portion forming a U-shaped neck engaging portion and a bib retaining member attached to each end portion of said elongate resilient member;

attaching a bib to one of said bib retaining members;

compressing said elongate resilient member by moving the opposite end portions toward each other; and attaching said bib to the other of said bib retaining members at a position spaced from said one bib retaining member while said elongate resilient member is compressed, such that when the elongate resilient member is released, the portion of the bib between the spaced bib retaining members is under tension and said bib is held adjacent said person's chin.

3. The method of claim 2, wherein said bib retaining members comprise spring clips.

4. The method of claim 3, wherein said bib retaining device further comprises a first cushioning tube member, wherein said elongate resilient member is disposed within said first cushioning tube member.

5. The method of claim 4, wherein said bib retaining device further comprises a second cushioning member, wherein at least a portion of said first cushioning tube member is disposed within said second cushioning tube member.

6. The method of claim 2, wherein when said elongate resilient member is both compressed and released said elongate resilient member puts pressure on said person's neck.

7. A device comprising:

an elongate resilient member having a central portion and opposite end portions;

said central portion of said elongate resilient member being formed into a neck engaging portion;

said end portions outwardly extending from said neck engaging portion;

a bib retaining member attached to each end portion of said elongate resilient member; and a cushioning member disposed on at least a portion of said elongate resilient member, wherein said cushioning member has an asymmetric cross-section and is eccentrically rotatable with respect to said elongate resilient member.

8. A device comprising:

an elongate spring member having a central portion and opposite end portions;

said central portion of said elongate spring member being U-shaped such that it forms a curved portion intermediate substantially parallel leg portions;

the opposite end portions of said spring member extending outwardly from said central portion such that each end portion forms an obtuse angle with respect to its corresponding leg portion; and a bib retaining member attached to each end portion of said elongate spring member.

* * * * *